United States Patent [19]

Griffiths

[11] Patent Number: 4,867,698

[45] Date of Patent: Sep. 19, 1989

[54] ANTENNA CONNECTOR

[75] Inventor: Wayne S. Griffiths, York, Pa.

[73] Assignee: AMP Incorporated, Harrisburg, Pa.

[21] Appl. No.: 151,867

[22] Filed: Feb. 3, 1988

[51] Int. Cl.[4] ..... H01R 4/54

[52] U.S. Cl. ..... 439/317; 439/311; 439/916; 439/750; 343/702; 343/906

[58] Field of Search ..... 439/750, 916, 801, 805, 439/662–664, 578–585, 675, 332–338, 310–312, 314–319; 343/902, 900, 906

[56] References Cited

U.S. PATENT DOCUMENTS

| | | | |
|---|---|---|---|
| 3,453,766 | 1/1969 | Ziegler Jr. et al. . | |
| 3,789,418 | 1/1974 | Reiber et al. . | |
| 3,944,722 | 3/1976 | Larsen . | |
| 4,165,911 | 8/1979 | Laudig . | |
| 4,322,121 | 3/1982 | Riches et al. | 439/312 |
| 4,435,713 | 3/1984 | Gasparaitis et al. . | |
| 4,523,197 | 6/1985 | Imazeki et al. . | |
| 4,611,213 | 9/1986 | Johnson et al. . | |

*Primary Examiner*—David Pirlot

[57] ABSTRACT

A coaxial electrical connector for connecting an antenna to a walkie talkie radio or the like includes a center contact member (21) for electrically connecting the antenna (12) to the radio (10), and a collar (23) having bayonet coupling structure (67) for mechanically coupling the connector to the outer contact (71) of a complementary coaxial connector (50) in the radio (10) without electrically connecting the connector to the outer contact (71). Because the antenna does not require coaxial electrical connection to the radio, the outer contact is eliminated from the coaxial connector of the present invention and replaced in support function by a semirigid, dielectric shell (22) which both electrically insulates the center contact member (21) and provides mechanical support to resist stresses caused by loads applied to the antenna. The connector optionally also includes a plastic sleeve (24) surrounding the collar (23) and retained in position therearound, for helping to protect the connector and for providing the connector with a more attractive external appearance.

9 Claims, 3 Drawing Sheets

ANTENNA CONNECTOR

BACKGROUND OF THE INVENTION

The present invention relates generally to electrical connectors and, more particularly, to coaxial, electrical connectors for antennas.

Antennas used on portable walkie talkie radios generally comprise dielectric coated springs which are electrically and mechanically connected to the radios by coaxial, electrical connectors of the BNC type. The connectors are adapted to mate with complementary coaxial connectors built into the radio.

The complementary connector is of the coaxial type to permit test equipment and the like to be properly connected to the radio. The antenna does not require a coaxial electrical connection to the radio; however, to permit utilization of the coaxial complementary connector already in the radio, known antenna connectors for walkie talkie radios are normally also of the coaxial type.

Known coaxial antenna connectors included an electrically conductive center contact member and an electrically conductive, metal, outer shell electrically insulated from one another by a relatively soft, plastic, dielectric member. The center contact member was electrically connected to the antenna and was adapted to engage a center contact in the complementary connector to electrically connect the antenna to the complementary connector and, hence, to the radio. The outer shell was adapted to engage the outer contact of the complementary connector when the connectors were mated and additionally provided mechanical support to resist stresses placed on the connector by bending of the antenna during handling of the radio. In addition, the connector included bayonet coupling structure or other means for mechanically attaching the connector to the complementary connector in the radio.

The outer metal shell of the connector was a relatively expensive, machined part which contributed significantly to the cost of the connector. In addition, the exposed metal shell often required the inclusion of shielding structure in the connector, resulting in further cost.

SUMMARY OF THE INVENTION

The present invention provides a coaxial electrical connector for connecting an antenna to a complementary coaxial connector in a walkie talkie radio or the like. The connector comprises a center contact member having a first contact portion adapted to be electrically connected to the antenna, and a second contact portion adapted to engage a center contact in the complementary coaxial connector for electrically connecting the antenna to the complementary connector, a dielectric shell supporting the center contact member substantially axially therein, and a collar surrounding the dielectric shell and including coupling means for mechanically coupling the coaxial, electrical connector to the outer contact of the complementary connector without providing an electrical connection between the coaxial, electrical connector and the outer contact of the complementary connector.

Because the antenna does not require a coaxial, electrical connection to the radio, the outer contact is eliminated in the coaxial connector of the present invention; and the soft, dielectric member is replaced by a semirigid, dielectric shell which both electrically insulates the center contact member and provides a mechanical support for the antenna to help resist stresses on the connector caused by loads applied to the antenna. In addition, the connector includes a collar which surrounds the dielectric shell and which functions to mechanically connect the connector to the complementary connector without providing unnecessary electrical connection with the outer contact of the complementary connector.

The single, semirigid, dielectric shell is preferably formed of a moldable plastic which can be manufactured at significantly less cost than the machined, outer, metal shell of prior coaxial antenna connectors. Also, because there is no exposed metal shell in the connector of the present invention, shielding is not required, permitting an even further reduction in cost.

According to a further aspect of the invention, the connector may also include a semirigid plastic sleeve which surrounds the collar and which functions to protect the connector and provide the connector with a more attractive external appearance. The sleeve is formed of a semirigid, plastic material and is relatively rigid to prevent accidental removal of the sleeve from the connector, but sufficiently flexible to permit operation of the bayonet coupling structure of the collar without removal of the sleeve. The sleeve also serves to hide the nature of the bayonet coupling structure to help prevent unauthorized removal of the antenna from the radio.

Further advantages and features of the invention will become apparent hereinafter in conjunction with the following detailed description of a presently preferred embodiment.

DETAILED DESCRIPTION OF THE PREFERRED EMBODIMENT

Figure 1:
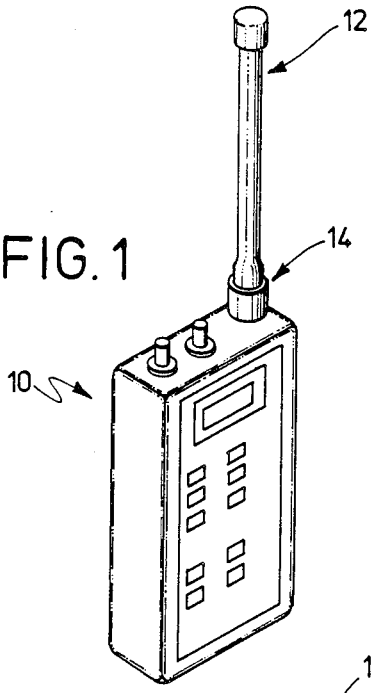
FIG. 1 is a perspective view of a walkie talkie radio having an antenna connected thereto.

FIG. 1 illustrates a radio 10 of the walkie talkie type having an antenna 12 electrically and mechanically connected thereto by a connector 14 according to the present invention. Connector 14 comprises a coaxial electrical connector of the BNC type and electrically and mechanically connects antenna 12 to radio 10 via a complementary coaxial connector 50 in the radio housing 11 (see FIG. 4).

Figure 4:
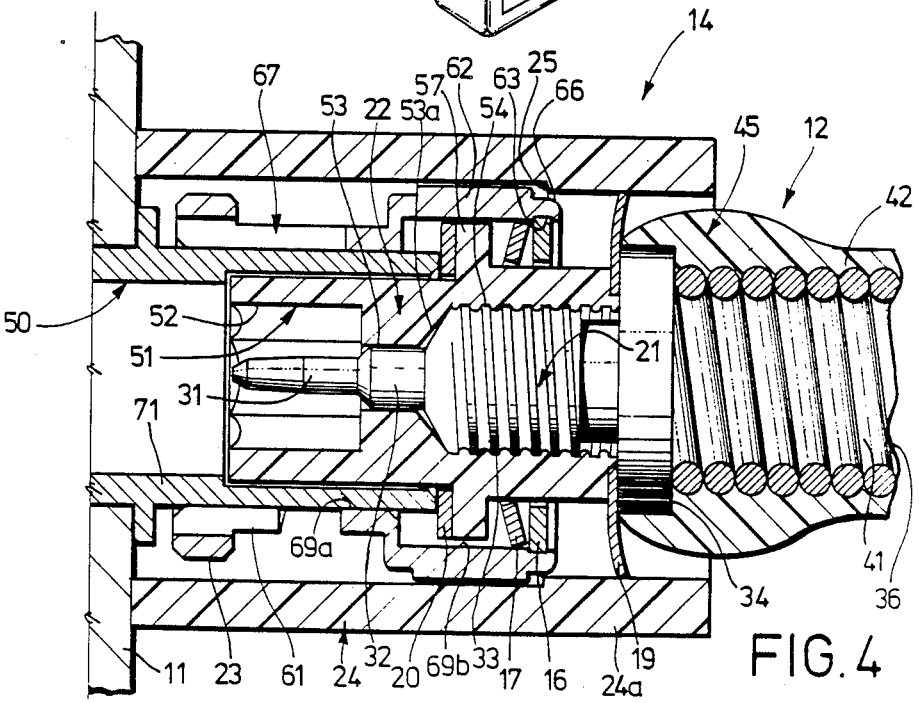
FIG. 4 is a fully assembled, cross sectional view of the connector of FIGS. 2 and 3 mated with a complementary connector in the radio of FIG. 1.
Figure 2:
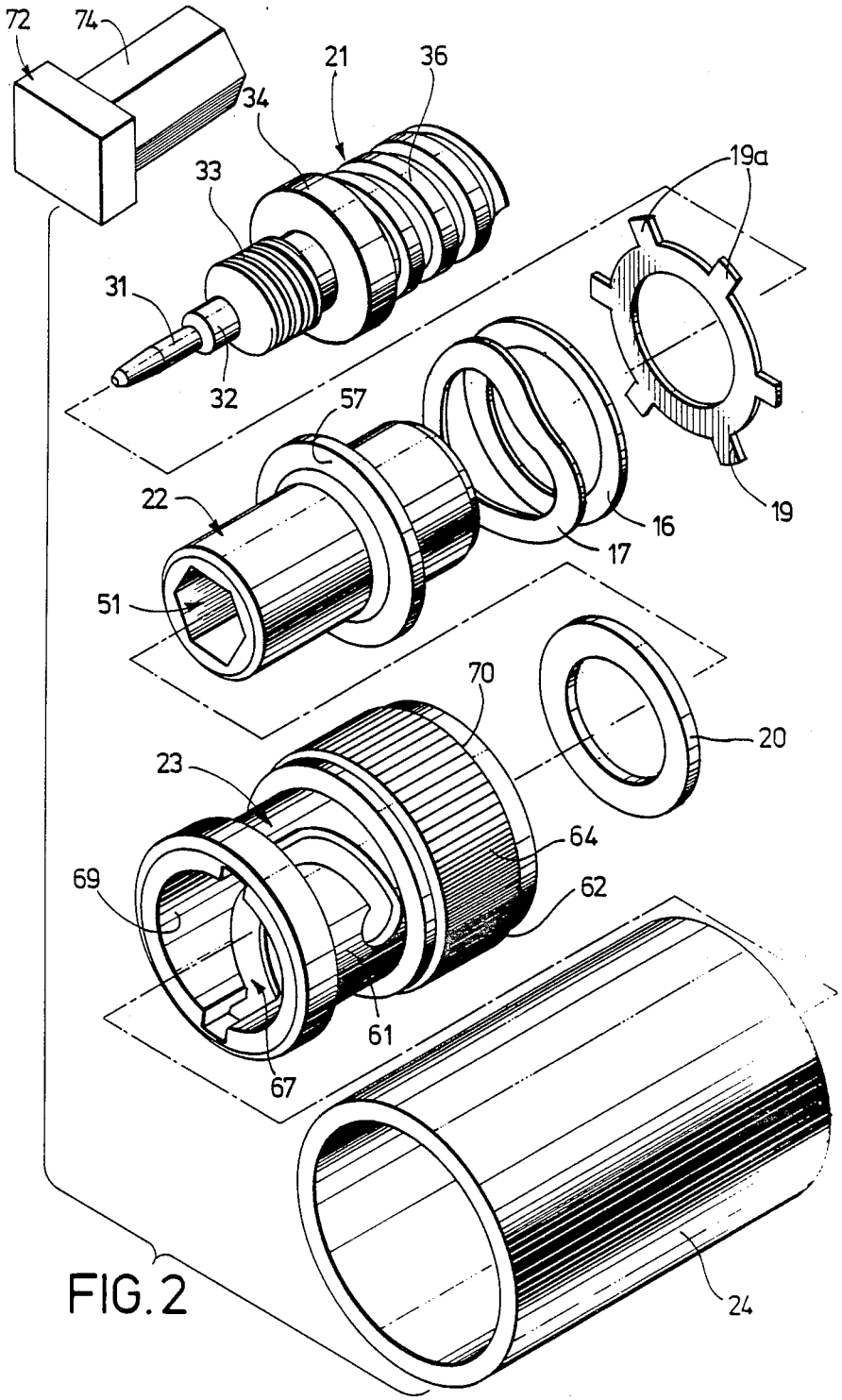
FIG. 2 is an exploded perspective view of an antenna connector according to a presently preferred embodiment of the invention.
Figure 3:
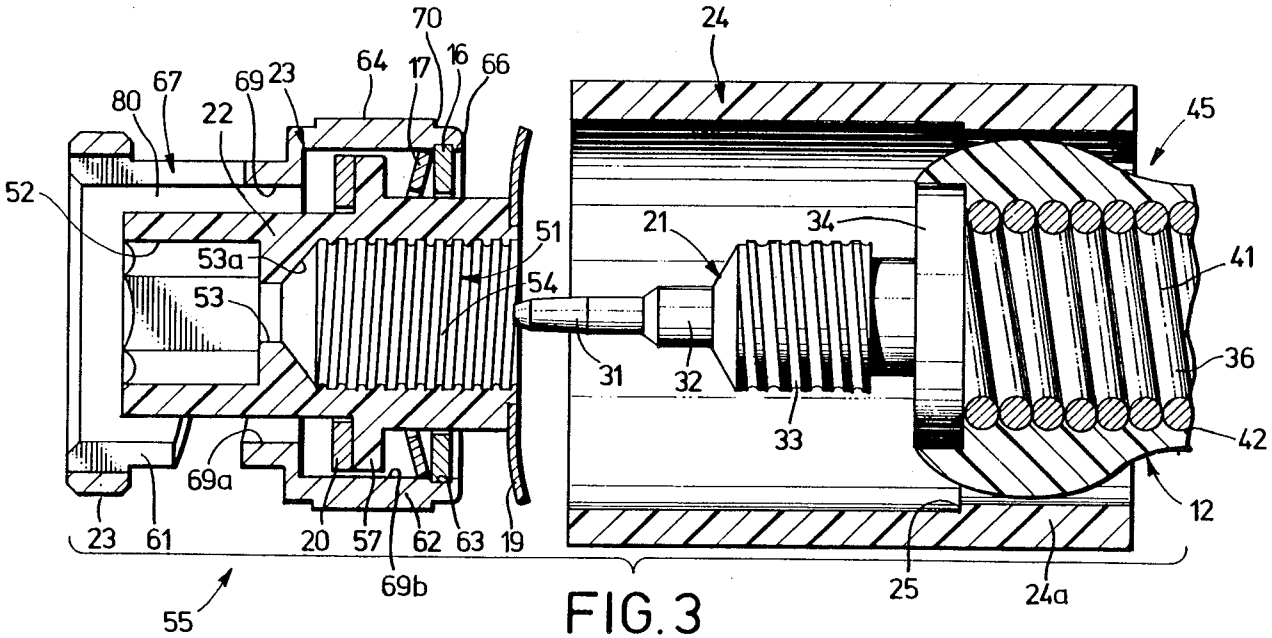
FIG. 3 is a partially assembled, cross sectional view of the connector of FIG. 2.

Connector 14 is illustrated in FIGS. 2–4 and generally comprises a center contact member 21 for electrically connecting the antenna to the radio, a dielectric shell 22 for supporting the center contact member, a collar 23 for mechanically coupling the connector to the complementary, coaxial connector in the radio, and, optionally, an outer plastic sleeve 24 for protecting the connector and for providing the connector with a smooth, attractive, external appearance.

Center contact member 21 includes forwardly extending pin contact portion 31 adapted to engage a center contact (not shown) in complementary connector 50, mid portion 32, first threaded portion 33, flange portion 34, and rearwardly extending, second, threaded portion 36 adapted to be connected to antenna 12. Antenna 12 is of generally conventional type and comprises an elongated coil spring 41. As shown in FIGS. 3 and 4, one end of spring 41 is mounted to second, threaded portion 36 of center contact member 21, and, preferably, is also soldered thereto to provide a reliable electrical connection therebetween. After attachment to portion 36 of center contact member 21, spring 41 is dipped into a plastisol or another suitable dielectric coating material or overmolded to apply a flexible, protective coating 42 thereto. As shown in FIGS. 3 and 4, coating 42 preferably extends over and around flange portion 34 of center contact member 21. After coating 42 is applied, center contact member 21 and antenna 12 define a center contact/antenna subassembly 45 adapted to be secured as a unit to the remainder of the connector structure.

Center contact/antenna subassembly 45 is adapted to be mounted within dielectric shell 22. Shell 22 comprises a generally cylindrical member formed of a suitable, semi rigid dielectric material and includes a passageway 51 extending axially therethrough. Passageway 51 includes a front passageway portion 52, a reduced diameter, central passageway portion 53, and a rear passageway portion 54. Front passageway portion 52 has a polygonal cross section, preferably a hexagonal cross section, as best shown in FIG. 2. Central passageway portion 53 is of generally cylindrical shape, but includes a rear section **53*a* of beveled configuration. Rear passageway portion 54 is threaded as shown in FIG. 3 to mate with first threaded portion 33 on center contact member 21 as will be explained hereinafter. Shell 22 further includes an outwardly extending, annular flange 57**.

Collar 23 comprises a generally cylindrical member and includes a forward coupling portion 61 and a rear body portion 62. Coupling portion 61 includes coupling structure 67 of the bayonet type for releasably coupling connector 14 to complementary connector 50 in radio 10. Bayonet type couplings are well known in the art (see, for example, U.S. Pat. Nos. 4,611,213 and 4,445,743) and, thus, are not described in detail herein. Body portion 62 has an outer knurled surface 64. An axial passageway 69 extends through collar 23 and includes a front passageway portion **69*a* in coupling portion 61 and an enlarged diameter rear passageway portion 69*b* in rear body portion 62**.

Sleeve 24 comprises a semirigid, plastic tube of, for example, a moldable polyester material. Sleeve 24 includes a rear portion **24*a* of slightly reduced inside diameter defined by an internal chamfer 25. As will be explained more fully hereinafter, sleeve 24 comprises part of an option package which may be included within connector 14 and is adapted to be slid down over antenna 12 and over collar 23 after the antenna is connected to radio 10** to protect the connector structure and provide the connector with a smooth, attractive external appearance.

To assemble connector 14, collar 23 is first assembled to dielectric shell 22 as shown in FIG. 3. Dielectric shell 22 is positioned within passageway 69 of collar 23 such that outwardly extending, annular flange 57 is positioned within enlarged diameter portion **69*b* of passageway 69. A thrust washer 20 is positioned around shell 22 in front of flange 57 when the shell is positioned within the collar. An annular spring 17 is also positioned around shell 22 behind annular flange 57, and an annular washer 16 is positioned in an annular counterbore 63 in bore 69*b* such that spring 17 is positioned between flange 57 and washer 16. A thin section 66 of rear body portion 62 of collar 23 is then bent inwardly to secure washer 16 in position as shown in FIG. 3. In this way, outer collar 23 and dielectric shell 22 are secured together as a subassembly 55 and are rotatable relative to one another. As will be explained hereinafter, shell 22 and collar 23 define an annular space 80 therebetween to receive the outer contact 71 of complementary connector 50** when the connectors are mated.

Thrust washer 20 functions to move the load line across flange 57 inwardly, increasing the shear area across flange 57 and reducing the risk of flange 57 being sheared as a result of external forces to generally strengthen the connector.

Collar/shell subassembly 55 is then mounted onto a holding jig 72 shown in FIG. 2 which includes a hexagonal section 74 configured to mate with the hexagonal front passageway portion 52 in dielectric shell 22. Jig 72 holds the dielectric shell stationary while the center contact/antenna subassembly 45 is secured within rear passageway portion 54 of shell 22. In particular, first threaded portion 33 of center contact member 21 is adapted to be threaded into rear, threaded passageway portion 54 of passageway 51 of dielectric shell 22 to secure the components together. Center contact/antenna subassembly 45 is threaded into dielectric shell 22, preferably by hand, until flange portion 34 engages the rear surface of shell 22, at which time center contact/antenna subassembly 45 is positioned substantially axially within dielectric shell 22 and collar 23. Pin contact portion 31 of center contact member 21 extends axially within front passageway portion 52 of shell 22, and mid portion 32 of center contact member 21 is positioned within reduced diameter central passageway portion 53 of shell 22. Jig 72 is provided with a central hole (not shown) to receive pin contact portion 31 during the threading operation.

The connector/antenna is then mated to complementary connector 50 as shown in FIG. 4 by coupling bayonet coupling structure 67 on collar 23 with complementary bayonet coupling structure (not shown) on outer contact 71 of the complementary connector under the influence of spring 17. When mated, outer contact 71 of the complementary connector extends into annular space 80 between shell 22 and collar 23; and pin contact portion 31 of center contact member 21 engages a center contact (not shown) in complementary connector 50 to complete electrical connection of antenna 12 to radio 10.

Following connection, plastic sleeve 24 is slid down antenna 12 and over collar 23 to complete the assembly. Sleeve 24 is slid over collar 23 until it impinges upon outer housing 11 of the radio. Sleeve 24 is retained in position around the collar by retaining ring 19. Retaining ring 19 permits sleeve 24 to be easily slid down over the connector, but includes a plurality of outwardly extending portions **19*a* (FIG. 2) which engage the reduced inside diameter portion 24*a* of sleeve 24 to oppose the removal thereof as best shown in FIG. 4**.

It should be understood that sleeve 24 is not an essential part of connector 14. Sleeve 24 and retaining ring 19 are adapted to comprise an option package which may be used to provide the connector with a smooth, attractive, external appearance and to help protect the connector. Connector 14 can, however, be used with or without the sleeve and retaining ring as desired. It should also be noted that sleeve 24, although surrounding collar 23, does not interfere with the operation of the bayonet coupling structure coupling connector 14 to complementary connector 50. Sleeve 24 is sufficiently flexible to permit a pair of pliers or a similar tool to be applied around the sleeve in the vicinity of the knurled outer surface 64 of collar 23 to permit, for example, collar 23 to be pressed downwardly and rotated to separate connector 14 from complementary connector 50 without removing the sleeve. Sleeve 24 also helps protect against unauthorized separation of connector 14 from complementary connector 50 because when sleeve 24 is in place over collar 23, the bayonet-coupling structure and the manner of separating the connectors is hidden from view.

By the present invention, a coaxial connector of the BNC type is provided for mounting an antenna to a walkie talkie radio or the like. The connector incorporates moldable plastic parts wherever possible, thus reducing its cost and simplifying its manufacture.

Because antenna 12 does not require a coaxial, electrical connection to radio 10, an outer contact has been eliminated from connector 14; and collar 23 provides only a mechanical coupling of the connector to the outer contact of complementary coaxial connector 50 in radio 10. In the present invention, the single, semirigid, dielectric shell 22 replaces a machined, metal, outer shell and a soft, dielectric insert used in many prior antenna connectors and functions to both insulate the center contact member and to provide mechanical support to resist stresses caused by bending of the antenna during handling of the radio. Dielectric shell 22 comprises a relatively inexpensive, moldable, plastic component, replacing the more costly, machined, electrically conductive, metal, outer shell of prior connectors, permitting a reduction in the overall cost of the connector.

While what has been described constitutes a presently most preferred embodiment, it should be recognized that the invention can take numerous other forms. For example, although the center contact/antenna subassembly is preferably threaded into the dielectric shell, other methods of attachment could be provided if desired. Because the invention can take other forms, it should be understood that the invention should be limited only insofar as required by the slope of the following claims.

I claim:

1. A coaxial electrical connector for connecting an antenna to a complementary coaxial connector which includes a center contact and an outer contact, comprising:

a center contact member having a first contact portion adapted to be electrically connected to the antenna, and a second contact portion adapted to engage the center contact in the complementary connector for electrically connecting said antenna to said complementary connector;

a dielectric shell supporting said center contact member substantially axially therein;

a collar surrounding said dielectric shell and including coupling means for mechanically coupling said coaxial electrical connector to the outer contact of said complementary connector without providing an electrical connection between said coaxial electrical connector and the outer contact of the complementary connector;

a plastic sleeve surrounding said collar for protecting said connector; and an annular retention ring for permitting said sleeve to be slid down over said antenna and over said collar and for thereafter opposing removal of said sleeve from around said collar.

2. The connector of claim 1 wherein said coupling means comprises releasable coupling means.

3. The connector of claim 1 wherein said releasable coupling means comprises bayonet coupling structure.

4. The connector of claim 1 wherein said sleeve is formed of semirigid material and is sufficiently flexible to permit operation of said coupling means through said sleeve without removing said sleeve.

5. The connector of claim 1 wherein said dielectric shell is formed of a semirigid, dielectric material for both electrically insulating the center contact member and for providing a mechanical support for the antenna to help resist stresses on the connector caused by bending of the antenna.

6. The connector of claim 5 wherein said dielectric shell includes an axial passageway having a threaded passageway portion, said center contact member extending into said axial passageway and including a threaded portion for threadedly engaging said threaded passageway portion.

7. A coaxial electrical connector for an antenna, comprising:

a center contact member including a forward contact portion for electrical connection to the center contact of a complementary coaxial connector and a rear contact portion for electrical connection to said antenna;

a semirigid, dielectric shell surrounding and supporting said center contact member substantially axially therein;

a collar surrounding said dielectric shell and defining an annular space between said collar and said dielectric shell for receipt of the outer contact of said complementary coaxial connector, said collar including bayonet coupling structure for mechanically coupling said collar to the outer contact of said complementary connector without providing an electrical connection between said coaxial electrical connector and the outer contact of said complementary coaxial connector;

a semirigid, plastic sleeve surrounding said collar; and an annular retention ring for permitting said sleeve to be slid down over said antenna and over said collar and for thereafter opposing removal of said sleeve from around said collar.

8. The connector of claim 7 wherein said sleeve is sufficiently flexible to permit operation of said bayonet coupling structure through said sleeve without removing said sleeve.

9. A coaxial connector having a gasket means positioned around a dielectric shell and positioned in front of a flange of the dielectric shell, wherein the improvement comprises;

a center contact member including a forward contact portion for electrical connection to the center contact of a complementary connector and a rear contact portion for electrical connection to an antenna, a semirigid dielectric shell surrounding and supporting said center contact member substantially axially therein, a collar surrounding said dielectric shell and defining an annular space between said collar and said dielectric shell for receipt of the outer contact of said complementary connector said collar including bayonet coupling structure for mechanically coupling said coaxial connector to said complementary connector without providing an electrical connection between said coaxial connector and the outer compact of said complementary connector, an outer circumferential flange on the dielectric shell, said gasket means comprising thrust washer means positioned around said dielectric shell and positioned in front of said flange, for moving a load line, across said flange, inwardly across an increased shear area of said dielectric shell to strengthen said coaxial connector when said coaxial connector is coupled to said complementary connector, a semirigid plastic sleeve for surrounding said collar, and an annular retention ring for permitting said sleeve to be slid down over said antenna and over said collar and for thereafter opposing removal of said sleeve from around said collar.

* * * * *

UNITED STATES PATENT OFFICE

CERTIFICATE OF CORRECTION

Patent No. 4,867,698 Dated September 19,1989

Inventor(s) Wayne Stewart Griffiths

It is certified that error appears in the above-identified patent and that said Letters Patent is hereby corrected as shown below:

In claim 9, column 7, line 4, after the word "connector" add a --,--; in line 9, change the word "compact" to --contact--.

Signed and Sealed this

Thirteenth Day of November, 1990

*Attest:*

HARRY F. MANBECK, JR.

*Attesting Officer*

*Commissioner of Patents and Trademarks*